US005438758A

United States Patent [19]

Roth-White

[11] Patent Number: 5,438,758

[45] Date of Patent: Aug. 8, 1995

[54] HEATED KNIFE

[76] Inventor: Jenny V. Roth-White, 78 Lancaster Drive, Broadstone, Dorset, United Kingdom, BH189EL

[21] Appl. No.: 251,188

[22] Filed: May 31, 1994

[51] Int. Cl.[6] ..... B26B 3/03

[52] U.S. Cl. ..... 30/140; 30/125

[58] Field of Search ..... 30/140, 123, 125, 45

[56] References Cited

U.S. PATENT DOCUMENTS

| | | | |
|---|---|---|---|
| 3,024,342 | 3/1962 | Birnbach et al. | 30/140 |
| 4,485,810 | 12/1984 | Beard | 30/140 X |
| 4,516,574 | 5/1985 | Hewes | 30/140 X |
| 5,064,993 | 11/1991 | Hashimoto | 30/140 X |

*Primary Examiner*—Douglas D. Watts

[57] ABSTRACT

A heated knife comprising a handle; a cutting blade formed of a thermally conductive material having a tip end and a base end with the base end coupled to the handle; a heating element formed of a thermally conductive material disposed within the cutting blade with a portion thereof extended from the base end of the cutting blade; a power source coupled to the handle with the power source adapted to energize the heating element; and a switch coupled between the heating element and the power source and connected to the handle with the switch having one orientation for de-energizing the heating element and another orientation for energizing the heating element, whereby allowing the cutting blade to be heated.

2 Claims, 3 Drawing Sheets

FIG. 1
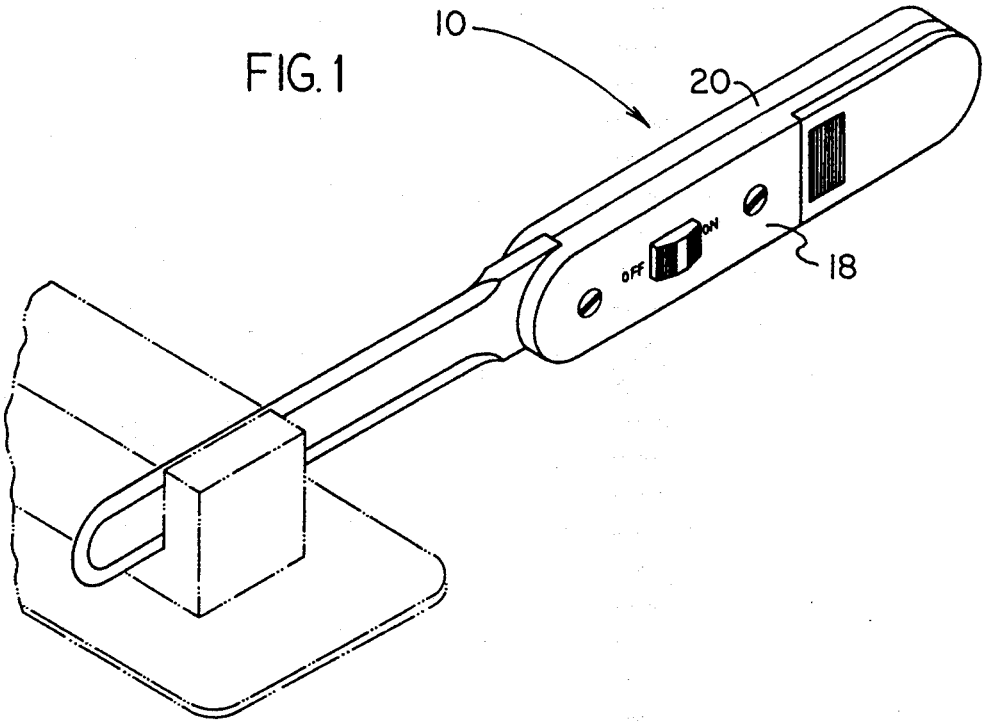
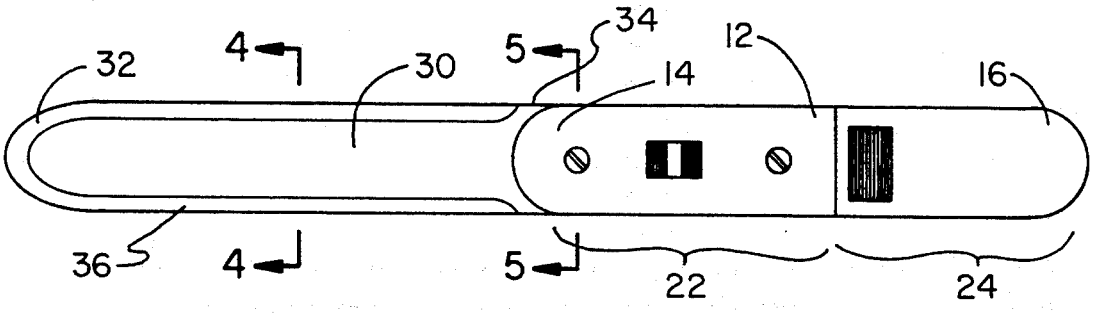
FIG. 2

HEATED KNIFE

BACKGROUND OF THE INVENTION

1. Field of the Invention

The present invention relates to a heated knife and more particularly pertains to cutting and spreading butter, cheese, and the like with the assistance of thermal conduction with a heated knife.

2. Description of the Prior Art

The use of heated knife assemblies is known in the prior art. More specifically, heated knife assemblies heretofore devised and utilized for the purpose of cutting and spreading food stuffs are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 331,686 to Persson discloses a butter knife. U.S. Pat. No. 3,606,216 to Chambers discloses a battery powered electric knife. U.S. Pat. No. 4,102,341 to Ikuno et al. discloses an electric knife device. U.S. Pat No. 4,593,466 to O'Brien discloses an electric knife. U.S. Pat No. 5,092,208 to Rosa-Miranda discloses a hot knife assembly.

While these devices fulfill their respective, particular objective and requirements, the aforementioned patents do not describe a heated knife that contains a heating element in the cutting blade thereof for allowing the cutting blade to be heated for readily cutting butter, cheese, and the like.

In this respect, the heated knife according to the present invention substantially departs from the conventional concepts and designs of the prior art, and in doing so provides an apparatus primarily developed for the purpose of cutting and spreading butter, cheese, and the like with the assistance of thermal conduction.

Therefore, it can be appreciated that there exists a continuing need for new and improved heated knife which can be used for cutting and spreading butter, cheese, and the like with the assistance of thermal conduction. In this regard, the present invention substantially fulfills this need.

SUMMARY OF THE INVENTION

In the view of the foregoing disadvantages inherent in the known types of heated knife assemblies now present in the prior art, the present invention provides an improved heated knife. As such, the general purpose of the present invention, which will be described subsequently in greater detail, is to provide a new and improved heated knife and method which has all the advantages of the prior art and none of the disadvantages.

To attain this, the present invention essentially comprises, in combination, a rigid, elongated, and plastic handle having a rounded tip end and a rounded base end with the handle formed of a generally concave first section coupled to an opposed and generally concave second section to define a switch compartment therein located near the tip end and battery compartment therein located near the base end with the base end of the handle further having a removeable door formed thereon for allowing access to the battery compartment. An elongated, rigid, and linear cutting blade is included and formed of a thermally conductive metal having a rounded tip end, a base end, and a cutting edge formed on the peripheral extent thereof with the base end coupled to and aligned with the tip end of the handle. An electrically conductive heating element is included and formed of a thermally conductive wire having two free ends and an intermediate portion therebetween with the intermediate portion thereof disposed within the cutting blade in a generally U-shaped configuration and positioned near the cutting edge and the free ends thereof extended from the base end of the cutting blade. An electrical power source is included and formed of at least one replaceable battery disposed within the battery compartment with the power source adapted to electrically energize the heating element. Lastly, a switch is coupled between the free ends of the heating element and the electrical power source, disposed within the switch compartment, and extended through and connected to the handle with the switch having one orientation for de-energizing the heating element and another orientation for energizing the heating element, whereby allowing the cutting blade to be heated to a temperature of approximately 40 degrees Centigrade.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved heated knife which has all the advantages of the prior art heated knife assemblies and none of the disadvantages.

It is another object of the present invention to provide a new and improved heated knife which may be easily and efficiently manufactured and marketed.

It is a further object of the present invention to provide a new and improved heated knife which is of durable and reliable construction.

An even further object of the present invention is to provide a new and improved heated knife which is susceptible of a low cost of manufacture with regard to both materials and labor, and which accordingly is then susceptible of low prices of sale to the consuming public, thereby making such a heated knife economically available to the buying public.

Still yet another object of the present invention is to provide a new and improved heated knife which provides in the apparatuses and methods of the prior art some of the advantages thereof, while simultaneously overcoming some of the disadvantages normally associated therewith.

Even still another object of the present invention is to provide a new and improved heated knife for cutting and spreading butter, cheese, and the like with the assistance of thermal conduction.

Lastly, it is an object of the present invention to provide a new and improved heated knife comprising a handle; a cutting blade formed of a thermally conductive material having a tip end and a base end with the base end coupled to the handle; a heating element formed of a thermally conductive material disposed within the cutting blade with a portion thereof extended from the base end of the cutting blade; a power source coupled to the handle with the power source adapted to energize the heating element; and a switch coupled between the heating element and the power source and connected to the handle with the switch having one orientation for de-energizing the heating element and another orientation for energizing the heating element, whereby allowing the cutting blade to be heated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the heated knife constructed in accordance with the principles of the present invention being utilized for cutting a stick of butter.

FIG. 2 is a side-elevational view of the present invention shown in FIG. 1.

The same reference numerals refer to the same parts through the various Figures.

DESCRIPTION OF THE PREFERRED EMBODIMENT

Figure 3:
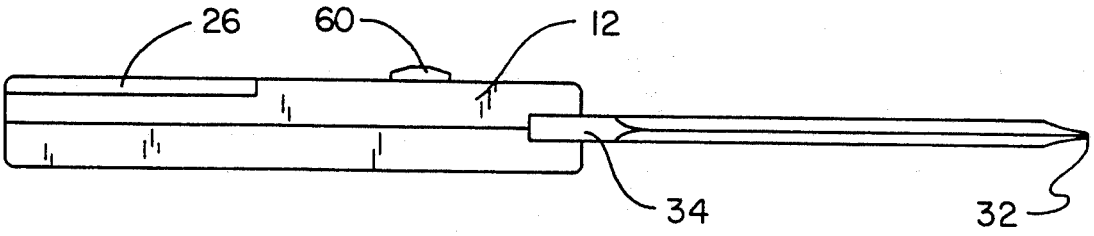
FIG. 3 is a plan view of the present invention shown in FIG. 1.
Figure 4:
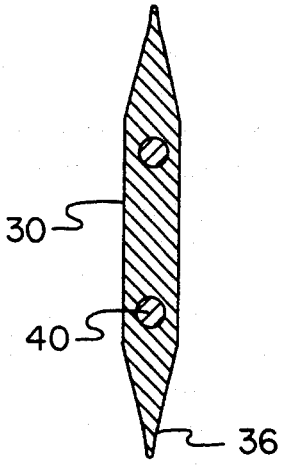
FIG. 4 is a cross-sectional view depicting the heating element within the cutting blade taken along the line 4—4 of FIG. 2.
Figure 5:
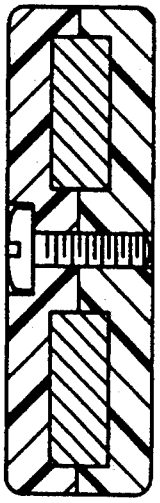
FIG. 5 is a cross-sectional view of the coupling between the blade and the handle taken along the line 5—5 of FIG. 2.
Figure 6:
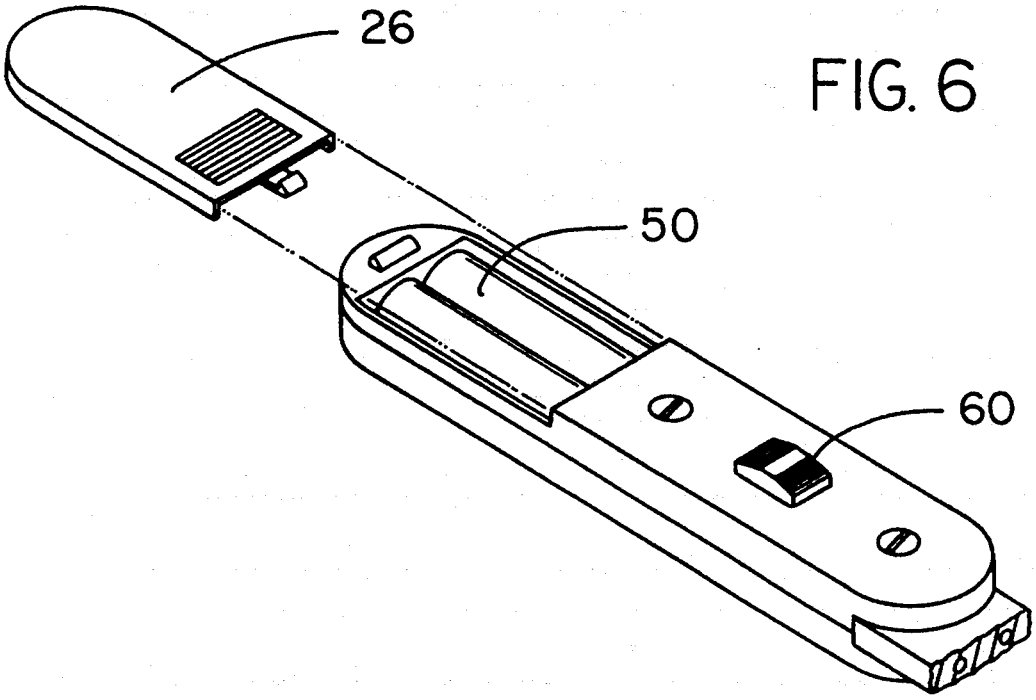
FIG. 6 is an enlarged perspective view of the handle of the present invention with the door removed for allowing access to the power source used for energizing the heating element.

With reference now to the drawings, and in particular, to FIG. 1 thereof, the preferred embodiment of the new and improved heated knife embodying the principles and concepts of the present invention and generally designated by the reference number 10 will be described.

Specifically, the present invention includes five major components. The major components are the handle, cutting blade, heating element, power source, and switch. These components are interrelated to provide the intended function.

More specifically, it will be noted in the various Figures that the first major component is the handle 12. The handle is rigid and elongated. It is formed of a plastic material. The handle has a rounded tip end 14 and a rounded base end 16. The handle is formed of a generally concave first section 18 coupled to an opposed and generally concave second section 20. The coupling of these two sections is performed with a pair of threaded screws. When coupled together, the sections define a switch compartment 22 therebetween located near the tip end. Also, a battery compartment 24 is formed therein and located near the base end. The base end of the handle further includes a door 26. The door allows access to the battery compartment. The door has a latch projected therefrom to couple with the handle. The door also includes a finger grip formed thereon for allowing the door to be slid open and slid closed.

The second major component is the cutting blade 30. The cutting blade is elongated, rigid, and linear in structure. It is formed of a thermally conductive metal. The cutting blade has a rounded tip end 32 and a base end 34. A cutting edge 36 is formed along the peripheral extent of the cutting blade. The base end 34 of the cutting blade is coupled to and aligned with the tip end 14 of the handle. In this configuration, the handle thus provides a way to position and hold the cutting blade for cutting foods such as butter and cheese.

The third major component is the heating element 40. The heating element is electrically conductive. It is formed of a thermally conductive wire having two free ends and an intermediate portion therebetween. The intermediate portion of the heating element is disposed within the cutting blade in a generally U-shaped configuration. The intermediate portion is also positioned within the cutting blade near the cutting edge thereof. The free ends of the heating element are extended from the base end 34 of the cutting blade. These free ends are adapted to be coupled with a power source for energizing the heating element, and thus heating the cutting blade.

The fourth major component is the power source 50. The power source is formed of at least one replaceable battery adapted to provide electrical energy. The power source is disposed within the battery compartment 24. The power source is adapted to electrically energize the heating element 40 through the free ends thereof. When the batteries are expended, they may be replaced.

Lastly, the fifth major component is the switch 60. The switch is coupled between the free ends of the heating element and the electrical power source 50. The switch is disposed within the switch compartment 22 and extended through and connected to the handle 12 between the door of the battery compartment and the tip end thereof. The switch has one orientation for de-energizing the heating element 40. The switch has another orientation for energizing the heating element, whereby allowing the cutting blade 30 to be heated. The power source, switch, and heating element in combination are designed such that they allow the cutting blade to be heated to a temperature of approximately 40 degrees Centigrade. At this temperature, food stuffs such as butter and cheese may be easily cut through without excessive melting of these food stuffs taking place.

In the preferred embodiment, the handle has a length of about 11 cm from the tip end to the base end and is formed of a brightly colored plastic. The width of the handle at the base end thereof is about 2 cm. The handle has a door formed thereon for placement of the batteries in the handle. The door is adapted for allowing the insertion of batteries. The door of the battery compartment is adapted to snap open to allow the insertion or removal of 2 AA sized 1.5 v batteries with electrical power supplied from the batteries being controlled through an ON/OFF switch.

Furthermore, a stainless steel blade with a filar wire running through inside of blade is utilized. The blade can be permanently attached to handle or be removable for sharpening. The length of the blade from the tip end thereof to where it connects with the tip end of the handle is about 11 cm in length. The thickness of the blade is about 2 mm. The width of the blade is about 2 cm. It is recommended that the blade be wiped clean with damp cloth only. The ON/OFF switch activates the heating element wire inside blade, whereby allowing the blade to warms up to a temperature of approximately 40 degrees Centigrade. The switch is located at a position on the handle where it may be readily actuated by a user's thumb.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A heated knife for cutting and spreading butter, cheese, and the like with the assistance of thermal conduction comprising, in combination:

a rigid, elongated, and plastic handle having a rounded tip end and a rounded base end with the handle formed of a generally concave first section coupled to an opposed and generally concave second section to define a switch compartment therein located near the tip end and battery compartment therein located near the base end, the base end of the handle further having a removable door formed thereon for allowing access to the battery compartment;

an elongated, rigid, and linear cutting blade formed of a thermally conductive metal having a rounded tip end, a base end, and a cutting edge formed on the peripheral extent thereof with the base end coupled to and aligned with the tip end of the handle;

an electrically conductive heating element formed of a thermally conductive wire having two free ends and an intermediate portion therebetween with the intermediate portion thereof disposed within the cutting blade in a generally U-shaped configuration and positioned near the cutting edge and the free ends thereof extended from the base end of the cutting blade;

an electrical power source formed of at least one replaceable battery disposed within the battery compartment with the power source adapted to electrically energize the heating element; and a switch coupled between the free ends of the heating element and the electrical power source, disposed within the switch compartment, and extended through and connected to the handle with the switch having one orientation for de-energizing the heating element and another orientation for energizing the heating element, whereby allowing the cutting blade to be heated to a temperature of approximately 40 degrees Centigrade.

2. A heated knife comprising:

an elongated linear handle having a length of about 11 cm;

an elongated linear cutting blade formed of a thermally conductive material having a rounded tip end, a base end axially aligned with and coupled to the handle, a length of between about 9 cm to 11 cm, a width of between about 1 cm to 3 cm, and a thickness of about 1 cm to 3 cm;

a heating element formed of a thermally conductive material disposed within the cutting blade with a portion thereof extended from the base end of the cutting blade;

a battery coupled to the handle with the battery adapted to energize the heating element; and a switch coupled between the heating element and the battery and connected to the handle with the switch having one orientation for de-energizing the heating element and another orientation for energizing the heating element, whereby allowing the cutting blade to be heated.

* * * * *